US010276282B2

(12) United States Patent
Puzella et al.

(10) Patent No.: US 10,276,282 B2
(45) Date of Patent: Apr. 30, 2019

(54) COAXIAL TRANSMISSION LINE STRUCTURE

(71) Applicant: Raytheon Company, Waltham, MA (US)

(72) Inventors: Angelo M. Puzella, Marlborough, MA (US); Lance A. Auer, Sun Lakes, AZ (US); Norman Armendariz, Plano, TX (US); Donald A. Bozza, Billerica, MA (US); John B. Francis, Littleton, MA (US); Philip M. Henault, Medway, MA (US); Randal W. Oberle, Plano, TX (US); Susan C. Trulli, Lexington, MA (US); Dimitry Zarkh, Waltham, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/663,128

(22) Filed: Jul. 28, 2017

(65) Prior Publication Data

US 2019/0035517 A1 Jan. 31, 2019

(51) Int. Cl.

| | |
|---|---|
| ***H01B 11/20*** | (2006.01) |
| ***H01B 11/18*** | (2006.01) |
| *H01P 11/00* | (2006.01) |

(52) U.S. Cl.

CPC ..... *H01B 11/20* (2013.01); *H01B 11/1808* (2013.01); *H01P 11/005* (2013.01)

(58) Field of Classification Search

CPC combination set(s) only.
See application file for complete search history.

(56) References Cited

U.S. PATENT DOCUMENTS 4,175,257 A * 11/1979 Smith ..... H03F 3/602 330/287
4,733,172 A * 3/1988 Smolley ..... G01R 1/07307 324/755.04

(Continued)

FOREIGN PATENT DOCUMENTS

| | | |
|---|---|---|
| EP | 1 928 053 A1 | 6/2008 |
| GB | 2 398 430 A | 8/2004 |

OTHER PUBLICATIONS

Harjinder Ladhar and Sundar Sethuraman, Assembly Issues with Microvia Technologies, Solectron Corporation, Journal of SMT, vol. 17 Issue 1, 2004, pp. 41-47 (7 pages).

(Continued)

*Primary Examiner* — William H Mayo, III
*Assistant Examiner* — Krystal Robinson
(74) *Attorney, Agent, or Firm* — Daly, Crowley, Mofford & Durkee, LLP

(57) ABSTRACT

A coaxial transmission line structure having a center conductor section having an input contact and an output contact the output contact being larger than the input contact, the center conductor having a plurality of different geometrically shaped, electrically conductive layers having sizes progressively increasing from the input contact to the larger output contact to conductor transition from the input contact to the larger output contact, the electrically conductive layers being electrically interconnected by staggered microvias passing through dielectric layers to the center, and (B) an outer conductor section disposed about, coaxial with, and electrically isolated from, the center conductor by the dielectric layers.

21 Claims, 8 Drawing Sheets

(56) References Cited

U.S. PATENT DOCUMENTS

| | | | | |
|---|---|---|---|---|
| 5,084,651 | A * | 1/1992 | Farney | H01J 23/48 315/39.51 |
| 5,218,322 | A * | 6/1993 | Allison | H01P 5/12 330/286 |
| 5,347,086 | A | 9/1994 | Potter et al. | |
| 5,668,509 | A * | 9/1997 | Hoffmeister | H01P 1/047 333/260 |
| 6,486,414 | B2 * | 11/2002 | Kobayashi | H05K 1/0222 174/255 |
| 7,463,122 | B2 * | 12/2008 | Kushta | H01P 3/06 333/260 |
| 9,577,035 | B2 | 2/2017 | Hurwitz et al. | |
| 9,980,370 | B2 * | 5/2018 | Kashiwakura | H01P 1/045 |
| 2002/0166689 | A1 * | 11/2002 | Maetani | H01L 23/49838 174/521 |
| 2004/0069529 | A1 | 4/2004 | Oggioni et al. | |
| 2006/0097906 | A1 * | 5/2006 | Heide | G01S 7/032 342/22 |
| 2008/0291115 | A1 * | 11/2008 | Doan | H01Q 1/38 343/893 |
| 2009/0133913 | A1 | 5/2009 | Kushta et al. | |
| 2011/0267152 | A1 | 11/2011 | Lee | |

OTHER PUBLICATIONS

Happy Holden, Lead-Free Reflow for High-Layer-Count PCBs, Retired and Michael Carano, OMG Electronic Chemicals, LLC., The PCB Magazine Apr. 2014, pp. 12-25 (14 pages).

Paul Reid, HDI PWB Reliability, The PCB Magazine, Apr. 2014, pp. 26-32 (7 pages).

Bob Gallant, Process for Blind Microvia Filling and Through-hole Metallization of High-Density Interconnects, Enthone, Inc., SMTAI, 2006, 6 pages.

Mumtaz Y. Bora, Qualification of ALIVH-G Boards for Handset Assembly, Kyocera Wireless Corporation, SMTAI, 2005, pp. 606-610 (5 pages).

Venky Sundaram, Venky Sundaram, Hunter Chan, Rao Tummala, Super High Density Two Metal Layer Ultra-Thin Organic Substrates for Next Generation System-on-System Package (SOP), SIP and Utra-Fine Pitch Flip-Chip Packages, Microsystems Packaging Research Center, Georgia Tech., Atotech, Rogers Corp.. Hugh Roberts. Pan Pacific, 2009, pp. 128-133 (6 pages).

Christian Romero, Jeongho Lee, and Youngdo Kweon, A High Dense Organic Interposer with Fine Feature Size for Advanced Packaging Applications, Advanced Circuit Interconnect Division, Samsung ElectroMechanics Co., Ltd., Proceedings of SMTA International, Rosemont, IL, Sep. 28-Oct. 4, 2014, pp. 20-26, 7 pages.

Steve Castaldi, Dennis Fritz, Limits of Copper Plating in High Aspect Ratio Microvias, MacDermid, Inc., SMTAI, 1999, pp. 748-754 (7 pages).

Notification of Transmittal of the International Search Report and Written Opinion of the ISA dated Oct. 18, 2018 for International Application No. PCT/US2018/040549; 1 Page.

International Search Report dated Oct. 18, 2018 for International Application No. PCT/US2018/040549; 5 Pages.

Written Opinion of the ISA dated Oct. 18, 2018 for International Application No. PCT/US2018/040549; 8 Pages.

Eric Holzman, Essentials of RR aand Microwave Grounding, 3.2 Coaxial Transmission Line, Artech House, Inc, 2006.

* cited by examiner

COAXIAL TRANSMISSION LINE STRUCTURE

TECHNICAL FIELD

This disclosure relates generally to coaxial transmission line structures and more particularly to coaxial transmission line structures having microvias forming an inner and outer conductor for the coaxial transmission line structures.

BACKGROUND

As is known in the art, microvias are minute holes drilled by a laser to generate the electrical connection between the layers in a multilayer circuit board. The microvia is typically a solid copper filled via with an aspect ratio ≤1:1 where the aspect ratio=microvia height divided by microvia diameter (taken at the top of the microvia hole). A microvia is used to connect RF, power and logic signal transmission lines to fine-pitch, high pin count active MMICs (monolithic microwave integrated circuit), ASICs and plastic quad flat packages. Microvia interconnect technology enables: High density component layout on Printed Wiring Boards (PWBs). Microvias may use a direct solder reflow interconnect to component signal pad (e.g., MMIC and/or passive component); eliminate a "fan-out" pad from a plated through hole (PTH); and reduces parasitic inductance: critical for RF and high speed digital signals.

In many applications it is required to connect electrical outputs of a Microwave Monolithic Integrated Circuit (MMIC) to a larger microwave component. It also sometimes required to supply power and logic signals to such component. A multi-level printed circuit board (PCB) may be required to make these connections between the MMIC and the microwave component using coaxial connectors. The center coaxial connector would have one end connected to the solder ball and the other end connected to a much larger contact pad. For example, the solder ball of the MMIC may have a diameter of 0.006 inches and the contact pad to connect to the microwave component may have a have a diameter of 0.066 inches.

SUMMARY

In accordance with the present disclosure, a coaxial transmission line structure is provided having: (A) a center conductor section having an input contact and an output contact the output contact being larger than the input contact, the center conductor having a plurality of electrically conductive layers sizes progressively increasing from the input contact to the larger output contact to conductor transition from the input contact to the larger output contact, the electrically conductive layers being electrically interconnected by staggered microvias passing through dielectric layers to the center; and (B) an outer conductor section disposed about, coaxial with, and electrically isolated from, the center conductor by the dielectric layers.

In one embodiment, a coaxial transmission line structure is provided having: a center conductor section with an inner portion of a plurality of electrically conductive layers electrically interconnected by staggered microvias passing through dielectric layers; and an outer conductor section. The outer conductor section is disposed about, coaxial with, and electrically isolated from, the center conductor by the dielectric layers. The outer conductor section a second plurality of staggered micro vias passing through the dielectric layers for electrically interconnecting an outer portion of the electrically conductive layers; the outer portion being dielectrically spaced from the inner portion. The inner portion of one of the electrically conductive layers has a geometric shape different from a geometrical shape of the inner portion of another one of the plurality of electrically conductive layers.

In one embodiment the inner portion of one of the electrically conductive layers has a geometric shape different from a geometrical shape of the inner portion of another one of the plurality of electrically conductive layers.

In one embodiment, a coaxial transmission line structure is provided having: a center conductor section; a stack of vertically positioned dielectric layers; a plurality of electrically conductive layers, each one of the plurality of electrically conductive layers being disposed on a portion of a corresponding one of stack of vertically positioned dielectric layers; and an outer conductor section disposed about, coaxial with, and electrically isolated from, the center conductor section by the stack of vertically positioned dielectric layers. The center conductor section includes: an inner portion of the plurality of electrically conductive layers; and a first plurality of staggered or offset microvias passing through dielectric layers for electrically interconnecting the inner portion of the plurality of electrically conductive layers between and central, input contact and a central, output terminal. The outer conductor section includes: an outer portion of the plurality of electrically conductive layers; and a second plurality of staggered or offset microvias passing through dielectric layers for electrically interconnecting the outer portion of the plurality of electrically conductive layers. The inner portion of one of the plurality of electrically conductive layers has a geometric shape different from a geometrical shape of the inner portion of another one of the plurality of electrically conductive layers.

With such an arrangement, the shapes minimize parasitic inductance and capacitive coupling between the center conductor section and the outer conductor and signal transmission lines.

In one embodiment, the geometrical shape of said one of the first plurality of electrically conducive layers is oval and the geometrical shape of said another one of the first plurality of electrically conductive layers is circular.

In one embodiment, the second plurality of electrically conductive vias is disposed circumferentially around the center conductor section.

In one embodiment, the microvias in the first plurality of microvias passing through one of the stack of vertically positioned dielectric layers are offset from the microvias passing through a lower one of the stack of vertically positioned dielectric layers.

In one embodiment, microvias in the second plurality of microvias passing through one of the stack of vertically positioned dielectric layers are offset from the microvias passing through a lower one of the stack of vertically positioned dielectric layers.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Figure 1:
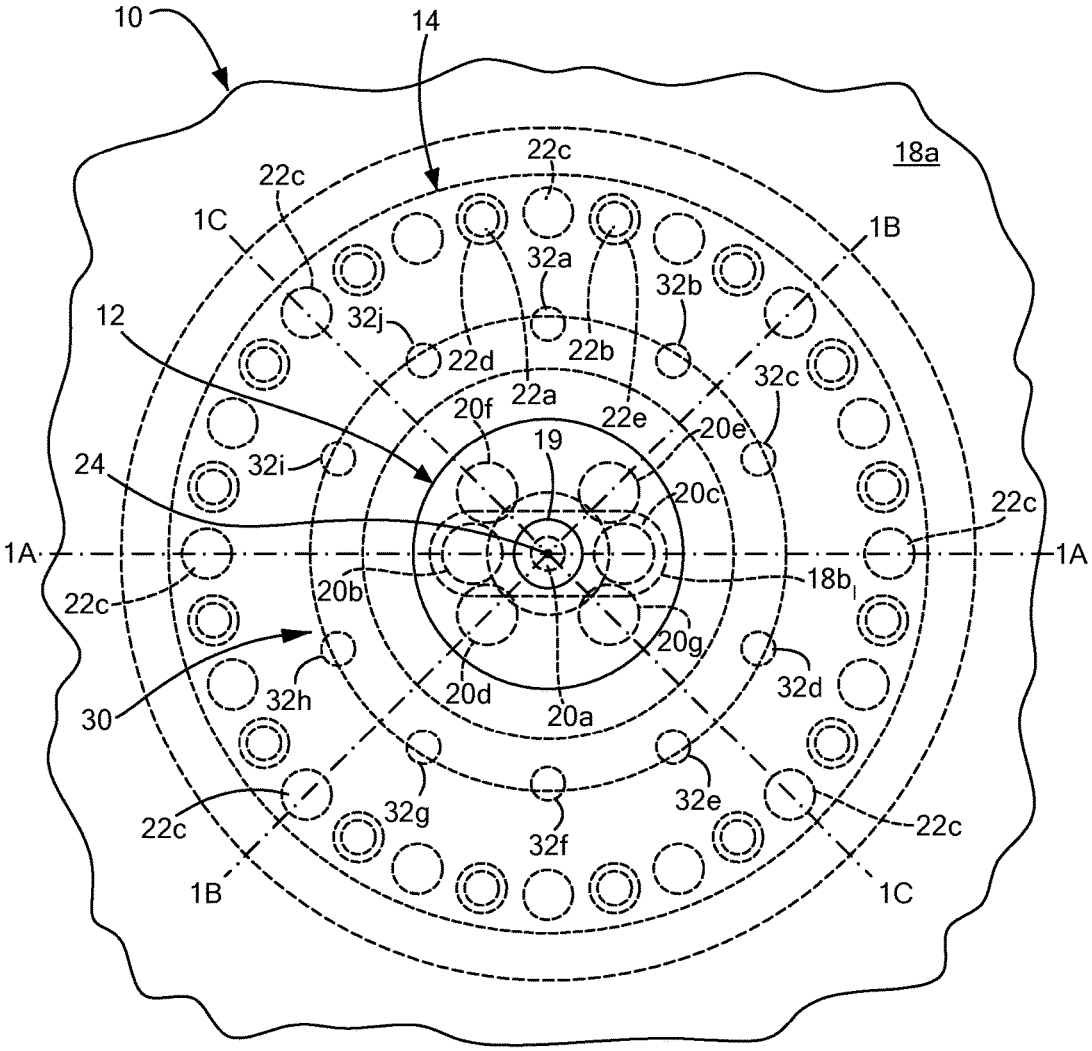
FIG. 1 is a plan view of a coaxial transmission line structure according to the disclosure.
Figure 1A:
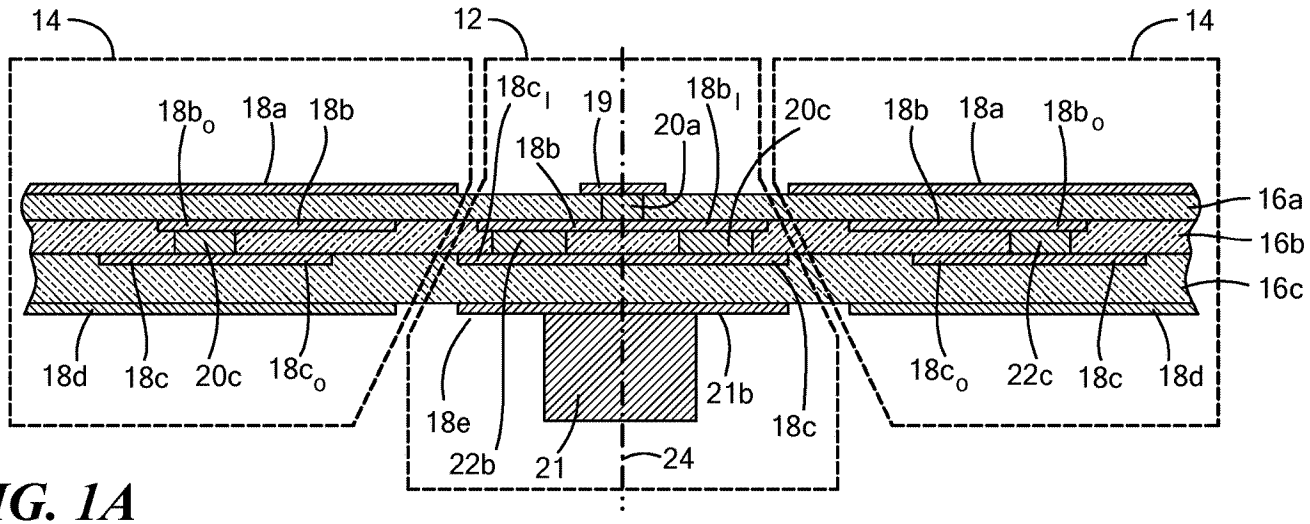
FIGS. 1A-1C are cross sectional views of the coaxial transmission line structure of FIG. 1, such cross sections being taken along lines 1A-1A; 1B-1B, and 1C-1C, respectively in FIG. 1 according to the disclosure.
Figure 1B:
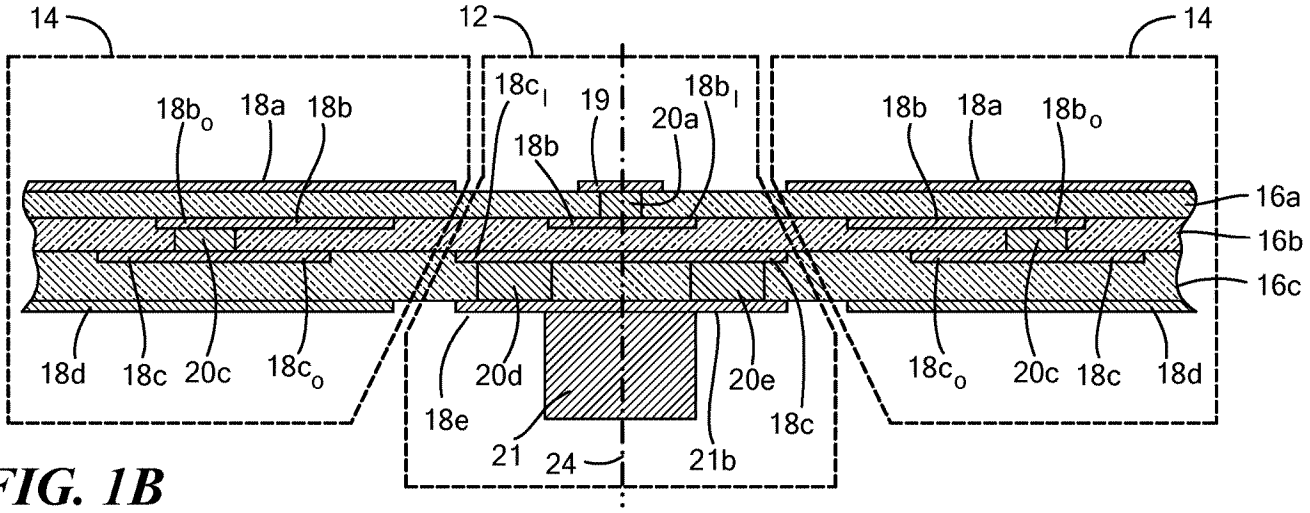
Figure 1C:
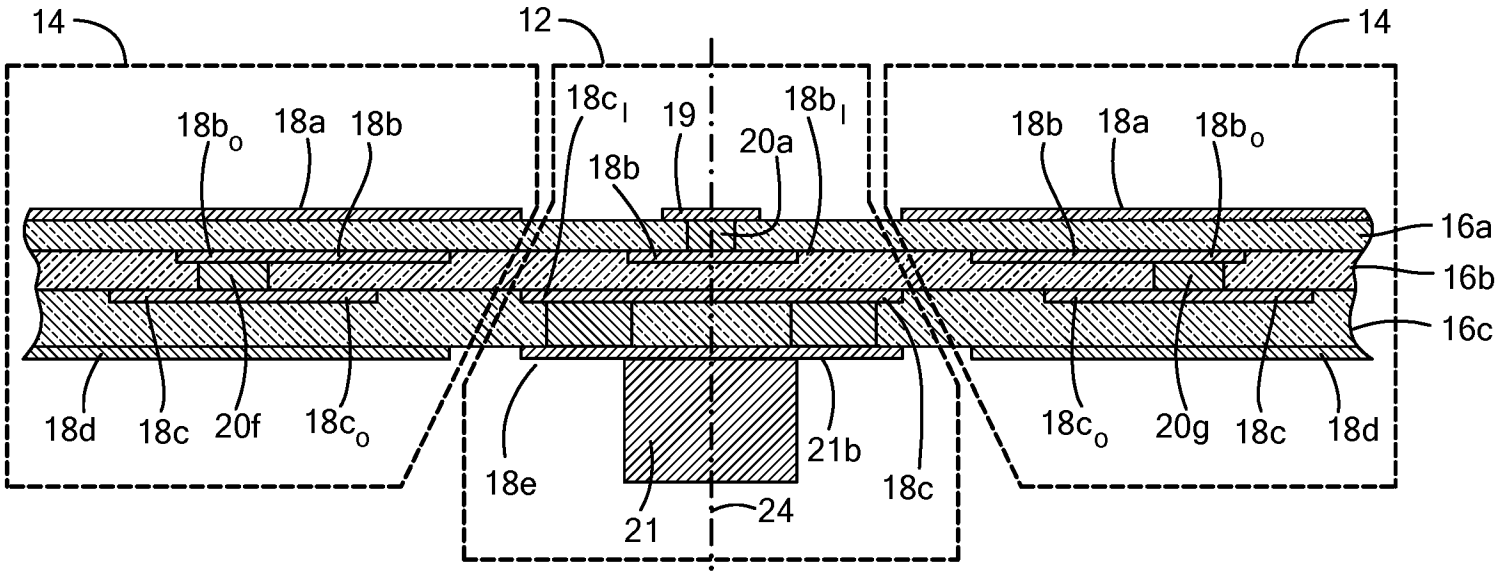
Figure 2:
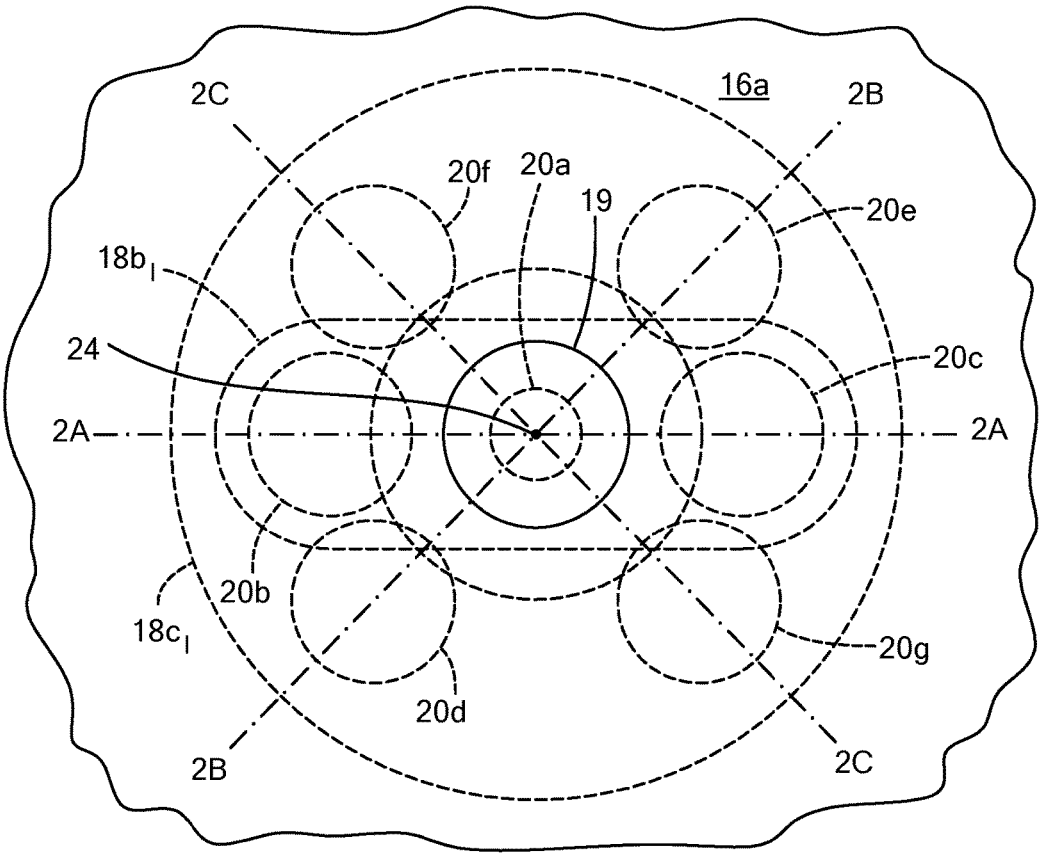
FIG. 2 is a plan view of a center conductor section of the coaxial transmission line structure of FIG. 1 according to the disclosure.
Figure 2A:
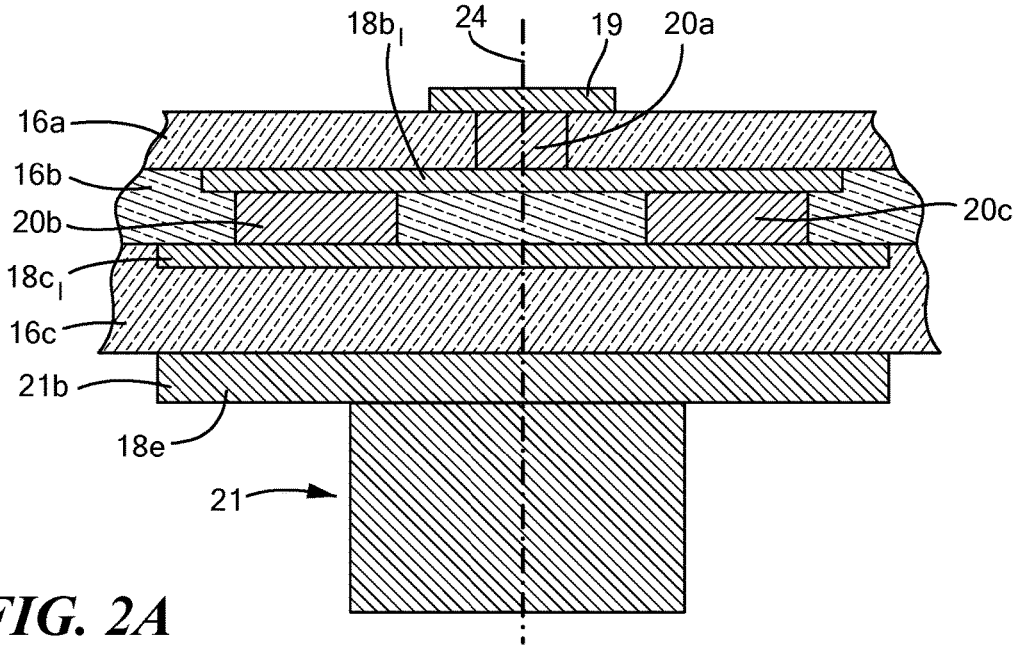
FIGS. 2A-2C are cross sectional views of the center conductor section of the coaxial transmission line structure of FIG. 2, such cross sections being taken along lines 2A-2A; 2B-2B, and 2C-2C, respectively in FIG. 2 according to the disclosure.
Figure 2B:
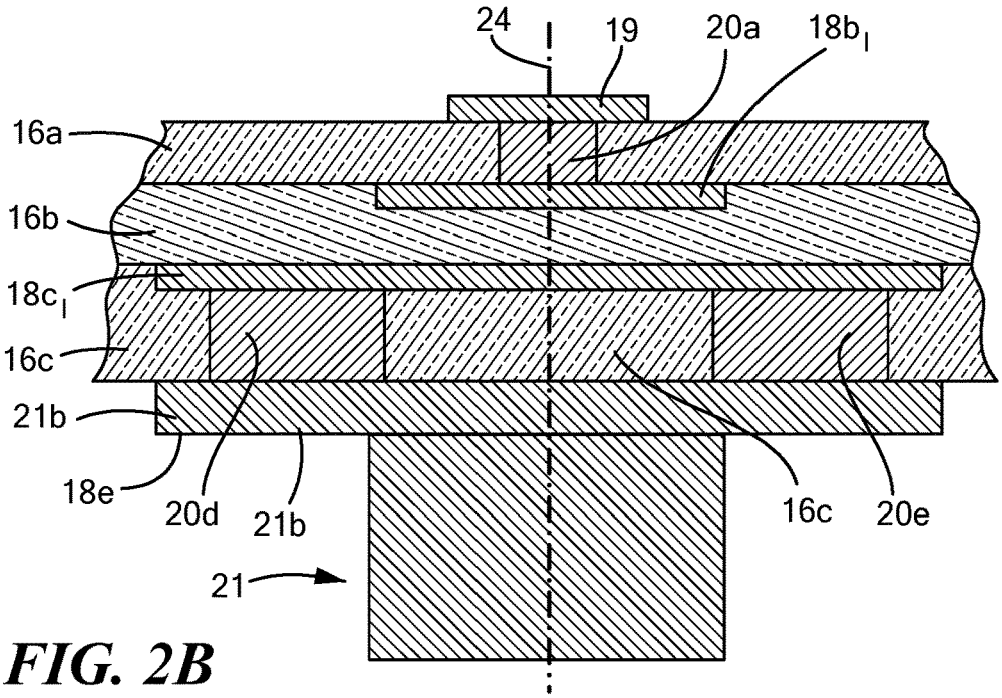
Figure 2C:
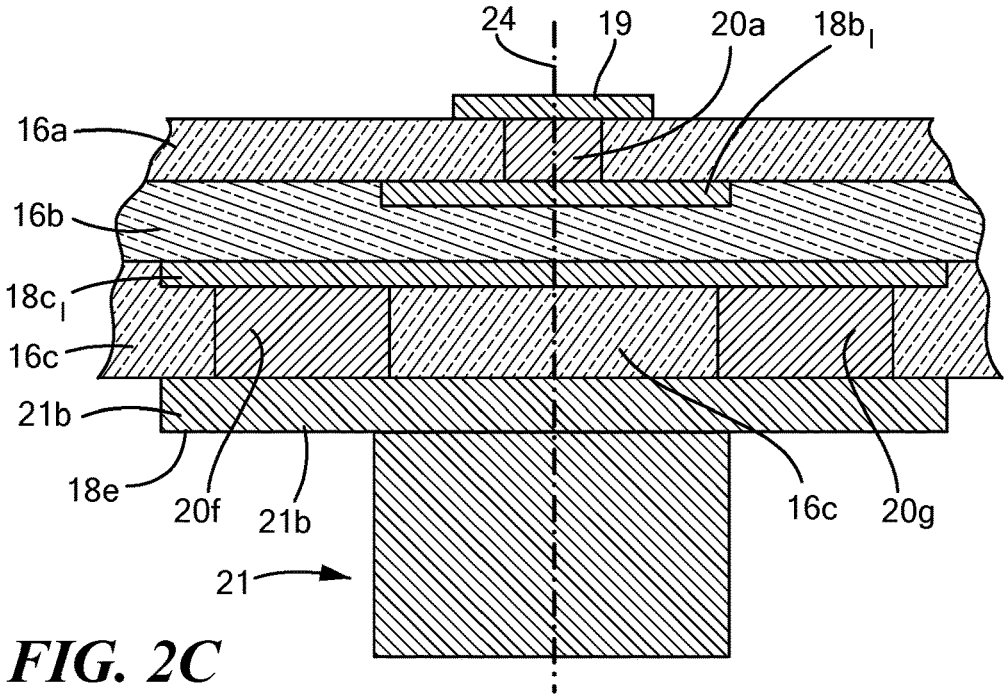
Figure 2D:
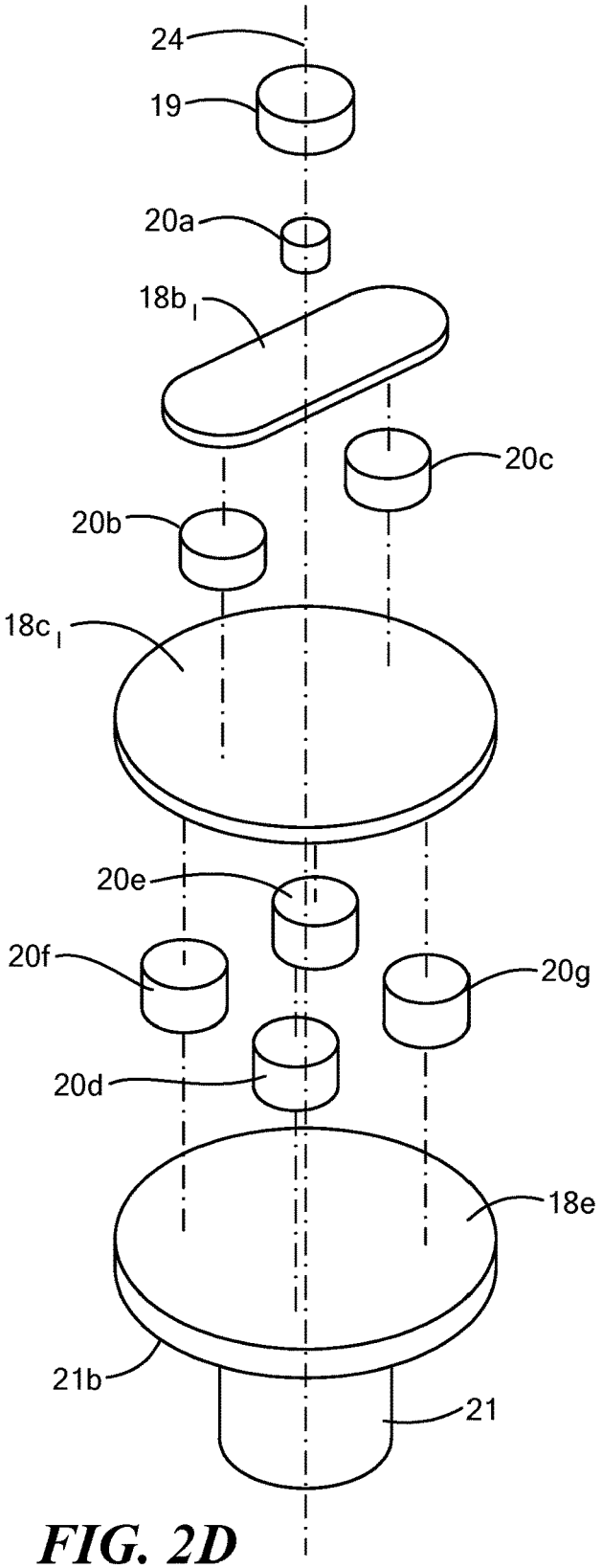
FIG. 2D is an exploded, simplified, perspective view showing the arrangement of conductive layers used in the center conductor section of the coaxial transmission line structure of FIG. 1.
Figure 3:
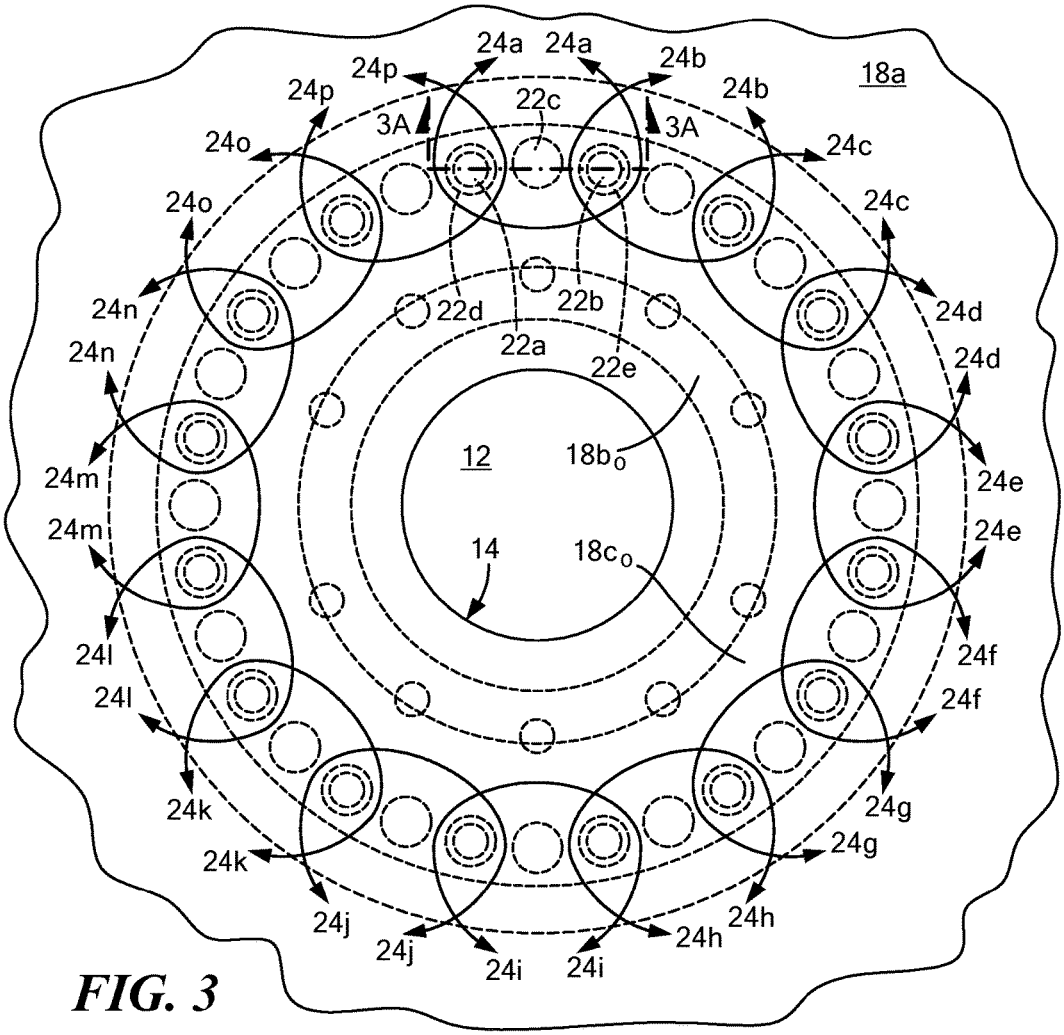
FIGS. 3 and 3A are plan and cross sectional view respectively showing in more detail an outer conductive structure of the coaxial transmission line structure of FIG. 1 according to the disclosure, the cross section of FIG. 3A being taken along line 3A-3A of FIG. 3.
Figure 3A:
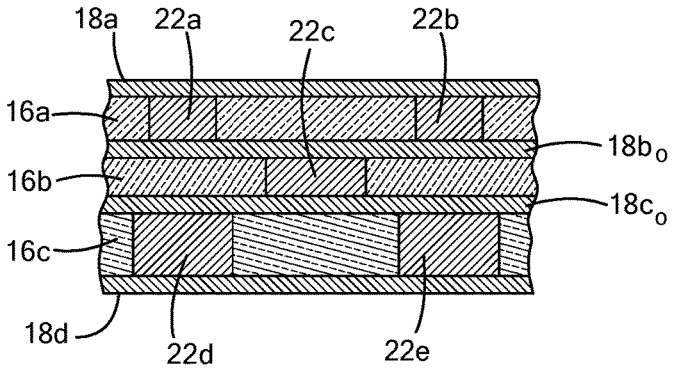
Figure 4:
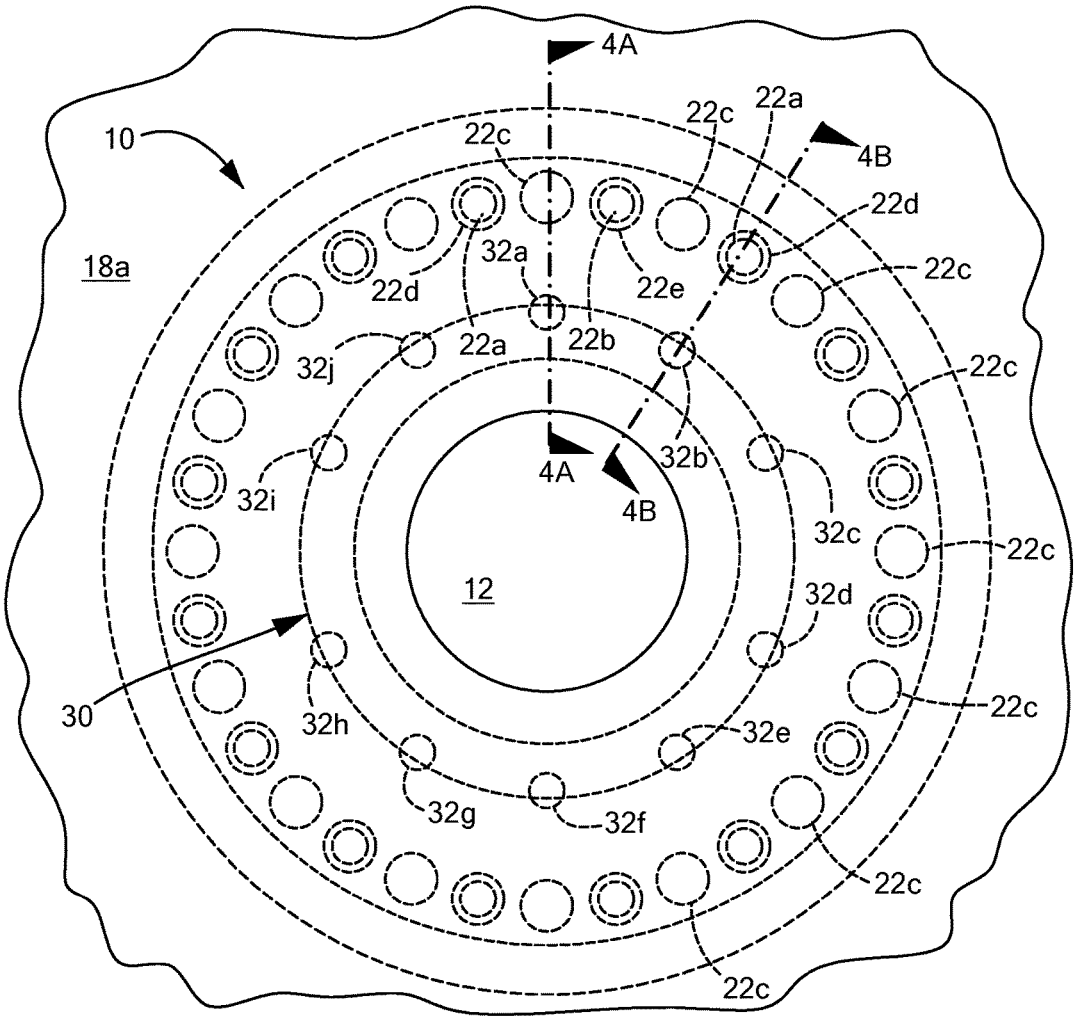
FIGS. 4 and 4A, 4B are plan and cross sectional view respectively showing in more detail an outer conductive structure of the coaxial transmission line structure of FIG. 1 according to the disclosure, the cross section of FIG. 4A being taken along line 4A-4A of FIG. 3.
Figure 4A:
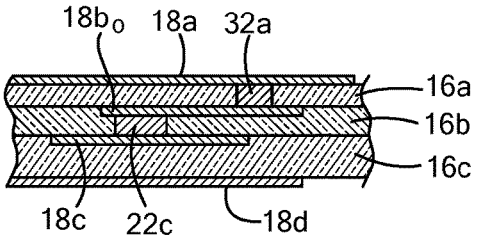
Figure 4B:
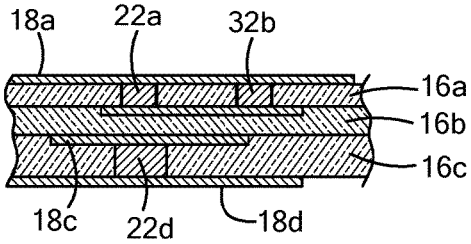

Referring now to FIGS. 1 and 1A-1C, a coaxial transmission line structure 10 is shown having: a center conductor section 12 (shown more clearly in FIGS. 2, and 2A-2D); and an outer conductor section 14 (shown more clearly in FIGS. 3 and 3A), disposed circumferentially about, coaxial with, and electrically isolated from, the center conductor section 12 by a stack of vertically positioned dielectric layers 16*a*-16*c*; and an intermediate electrical conductor shielding structure 30, having vias 32*a*-32*j*, disposed between the center conductor section 12 and the outer conductor section 14, to be described in more detail in connection with FIGS. 4, 4A and 4B.

More particularly, disposed on a portion of the upper surface of dielectric layer 16*a* is a central, input contact 19 and an upper conductive, ground plane, layer 18*a* dielectrically separated from the input contact 19 by the dielectric layer 16*a*. Disposed within upper surface portions of the dielectric layers 16*b* and 16*c* are electrically conductive layers 18*b* and 18*c*, respectively, as shown. Disposed on a portion of the bottom of dielectric layer 16*c* is a lower, conductive ground plane layer 18*d* and a layer 18*e* of the base portion 21*b* of an output contact 21.

It is first noted that input contact 19 which typically may contact a solder ball of an MMIC, not shown, and thus may have a diameter in a range of from 0.006 inches to 0.008 inches, is much smaller than the diameter of the output contact 21 which may typically be in a range of from 0.034 inches to 0.044 inches to contact with a another RF component, such as, for example, a circulator, not shown, mounted to a printed wiring board (PWB), not shown, such PWB having logic signal lines and power lines. Thus, the center conductor section 12 transitions the input contact 19 to the larger output contact 21 by including a plurality of electrically conductive layers $\mathbf{18}b_I$ and $\mathbf{18}c_I$ having sizes that progressively increase from the input contact 19 to the output contact 21; the electrically conductive layers $\mathbf{18}b_I$ and $\mathbf{18}c_I$ being electrically interconnected by staggered microvias 20*a*-20*g* passing through dielectric layers 16*a*-16*c* to electrically interconnect the input contact 19, the plurality of electrically conductive layers $\mathbf{18}b_I$, $\mathbf{18}c_I$ and conductive layer 18*e* of the base portion 21*b* of output contact 21, as shown.

It is also noted that the inner portion $\mathbf{18}b_I$, $\mathbf{18}c_I$, of the plurality of electrically conductive layers 18*b*, 18*c*, respectively, and layer 18*e* are part in the center conductor section 12 are dielectrically separated from outer portions $\mathbf{18}b_O$, $\mathbf{18}c_O$ of the electrically conductive layers 18*b* and 18*c*, respectively. The outer portions $\mathbf{18}b_O$, $\mathbf{18}c_O$ of the electrically conductive layers 18*b* and 18*c*, layer 18*a*, and layer 18*d* are part of the outer conductor section 14. The inner portion $\mathbf{18}b_I$, $\mathbf{18}c_I$, of the plurality of electrically conductive layers 18*b*, 18*c*, respectively, and layer 18*e* are dielectrically separated from the outer portions $\mathbf{18}b_O$, $\mathbf{18}c_O$ of the electrically conductive layers 18*b* and 18*c*, layer 18*a*, and layer 18*d* by intermediate portions of the dielectric layers 16*a*, 16*b* and 16*c*, as shown. As noted above, the input contact 19 disposed on a portion of the upper surface of dielectric layer 16*a* is dielectrically separated from the electrically conductive layer 18*a* by portions of dielectric layer 16*a* and the conductive layer 18*e* forming a base portion 21*b* of output contact 21 is disposed on the bottom surface of dielectric layer 16*c* and is dielectrically separated from the electrically conductive layer 18*d* by portions of dielectric layers 16*c*, as shown.

More particularly, and referring to FIGS. 2 and 2A-2D, the center conductor section 12 is shown in more detail. Thus, it is noted that the input contact 19, output contact 21, and the inner portion $\mathbf{18}b_I$, $\mathbf{18}c_I$, of the plurality of electrically conductive layers 18*b* and 18*c*, respectively, are electrically interconnected by, as noted above, the plurality of vertically staggered or offset, and horizontally spaced, microvias 20*a*-20*g* passing through dielectric layers 16*a*-16*c*. Thus, the input contact 19, the plurality of electrically conductive layers 18*a*-18*c* and conductive layer 18*e* of the base portion 21*b* of output contact 21, are all electrically interconnected, as shown. The spacing between the microvias 20*b*-20*g* is a function of the wavelength of the nominal operating wavelength of the coaxial transmission line structure 10; in any event the spacing will be a fraction of the nominal operating wavelength.

Still more particularly, microvia 20*a* is disposed along a central axis 24 of the coaxial transmission line structure 10, passes through dielectric layer 16*a* and is used to electrically connect the central, input contact 19 to the inner portion $\mathbf{18}b_I$ of conductive layer 18*b*. Microvias 20*b* and 20*c* are disposed along a diameter along line 2A-2A in FIG. 2 equidistant from the central axis 24, as indicated and pass through dielectric layer 16*b* and are used to electrically interconnect the inner portion $\mathbf{18}b_I$ of electrically conductive layer 18*b* to the conductive layer 18*c*1. Microvias 20*d* and 20*e* are disposed along a diameter 2B-2B in FIG. 2, diameter 2B-2B being at a 45 degree angle to diameter 2A-2A, as shown and being equidistant from the central axis 24, as indicated and pass through dielectric layer 16*c* and are used to electrically interconnect the inner portions $\mathbf{18}c_{I\ of}$ electrically conductive layer 18*c* to the conductive layer 18*e* forming a base portion 21*b* of output contact 21. Microvias 20*f* and 20*g* are disposed along a diameter 2C-2C in FIG. 2, diameter 2C-2C being at a 90 degree angle to diameter 2B-2B, as shown equidistant from the central axis 24, as indicated and pass through dielectric layer 16*c* and are used to electrically interconnect the inner portions of the electrically conductive layer of the conductive layer 18*e* forming a base portion 21*b* of output contact 21, as shown. It is noted that microvias 20*b* and 20*c* are laterally staggered or offset to the left and right of via 20*a*; microvias 20*d* and 20*e* are laterally staggered or offset to the left and right of via 20*a*; and, microvias 20*f* and 20*e* are laterally staggered or offset to the left and right of via 20*a*. It is further noted that microvias 20*d*, 20*e*, 20*f* and 20*g* are offset from microvias 20*b* and 20*c*.

It is noted that the inner portion $18b_I$ of electrically conductive layer 18*b* is oval-shaped while the inner portion layer $18c_I$ of electrically conductive layer 18*c* and the conductive layer 18*e* are circular shaped. The reason for this difference in shape between the electrically conductive layer 18*b* and the electrically conductive layers 18*c* and 18*e* is that the oval shape of inner portion 18*b*, for example, minimizes the shunt capacitive coupling between the inner conductor section 12 and the outer conductor structure 14. In addition, the parasitic inductance is reduced on the inner conductor section 12 due to multiple, staggered microvias 20*b, c* and 20*d*, 20*e*, 20*f*, and 20*g* that share RF current, reduce current density on the inner conductor section 12 and, thus, reduce the parasitic inductance of the inner conductor section 12. Further, the oval shape provides the mechanical interconnection between the two microvias 20*b* and 20*c*

Referring now to FIGS. 3 and 3A, the outer conductor section 14 is shown in more detail to include the electrically conductive layer 18*a*, the outer portions $18b_O$, and $18c_O$ of the electrically conductive layers 18*b* and 18*c*, respectively, and the conductive layer 18*d*. Here, for example, the conductive layer 18*a* and the outer portions $18b_O$ and $18c_O$, and layer 18*d* are each toroid or ring-shaped; a thin disk-shaped layer with a hole or aperture passing through the middle of the layer to expose the surface of the dielectric layer supporting the layer. As noted above, the center conductor section 12 is disposed within the aperture passing through the middle of the layer. It is noted that the outer conductor section 14 includes sixteen, identically constructed overlapping regions encircled by arrows 24*a*-24*a* through 24*p*-24*p* which are disposed coaxial with, and circumferentially about the center conductor section 12, as shown. Referring to an exemplary one of the regions, here for example the region encircled by arrows 24*a*-24*a*, as shown in FIG. 3A, each one of the regions includes a plurality of vertically staggered or offset, and horizontally spaced microvias 22*a*-22*e*, as shown for an exemplary one of the sixteen regions, as shown in FIG. 3A. The microvias 22*a*-22*e* in each one of the sixteen regions pass through the dielectric layers 16*a*-16*c* and are disposed between the electrically conductive layer 18*a*, and the outer portions $18b_O$, $18c_O$, and layer 18*d* as shown across a cord of the outer conductor section 14 in FIG. 3 to electrically interconnect the upper, conductive ground plane layer 18*a* and the portions $18b_O$, $18c_O$, and the lower conductive ground plane layer 18*d*, as shown.

Referring again to FIGS. 4, 4A and 4B, the coaxial transmission line structure 10 includes an electrically conductive shielding structure 30. The electrically conductive shielding structure 30 includes a plurality of horizontally spaced, identical microvias 32*a*-32*j* disposed circumferentially about the center conductor section 12; an exemplary one of the microvias, here microvias 32*a* and 32*b*, being shown in FIGS. 4A and 4B to pass through dielectric layer 16*a* to electrically connect layer 18*a* with the inner portion $18b_O$ of the electrically conductive layer 18*b*, as shown.

A number of embodiments of the disclosure have been described. Nevertheless, it will be understood that various modifications may be made without departing from the spirit and scope of the disclosure. For example, or for example, the diameter of, the coaxial transmission line structure 10 may be larger or smaller than that shown in which case the number of microvias will become correspondingly larger or smaller. Likewise the number and/or thicknesses of dielectric layers may be different, depending on the operating wavelength and power handling requirements of the coaxial transmission line structure 10 from that shown. Accordingly, other embodiments are within the scope of the following claims.

What is claimed is:

1. A coaxial transmission line structure, comprising:

(A) a center conductor section having an input contact and an output contact, the output contact being larger than the input contact, the center conductor having a plurality of electrically conductive layers with sizes progressively increasing from the input contact to the output contact, the electrically conductive layers being electrically interconnected by staggered microvias passing through dielectric layers; and (B) an outer conductor section disposed about, coaxial with, and electrically isolated from, the center conductor section by the dielectric layers.

2. The coaxial transmission line structure recited in claim 1 wherein the plurality of electrically conductive layers have different geometric shapes.

3. The coaxial transmission line structure recited in claim 1 including a ground plane conductor having an aperture therein, the aperture being coaxial with, and electrically isolated from, the center conductor section and wherein the outer conductor section comprises a plurality of vertically stacked, electrically connected conductive layers, each one of the conductive layer having an aperture therein, the aperture being coaxial with, and electrically isolated from, the center conductor section and wherein the outer conductor section is electrically connected to the ground plane conductor.

4. The coaxial transmission line structure recited in claim 3 including an intermediate electrical conductor shielding structure disposed between the center conductor section and the outer conductor section, such intermediate electrical conductor shield section comprising a plurality of electrically conducive vias disposed circumferentially abbot the center conductor section, electrically connecting the ground plane conductor to one of the plurality of vertically stacked, electrically connected conductive layers.

5. A coaxial transmission line structure, comprising:

a center conductor section with an inner portion of a first plurality of electrically conductive layers electrically interconnected by staggered microvias passing through dielectric layers; and an outer conductor section disposed about, coaxial with, and electrically isolated from, the center conductor by the dielectric layers, the outer conductor section comprising:

a second plurality of staggered microvias passing through the dielectric layers for electrically interconnecting an outer portion of the electrically conductive layers; the outer portion being dielectrically spaced from the inner portion; and wherein the inner portion of one of the electrically conductive layers has a geometric shape different from a geometrical shape of the inner portion of another one of the plurality of electrically conductive layers.

6. The coaxial transmission line structure recited in claim 5 including a ground plane conductor having an aperture therein, the aperture being coaxial with, and electrically isolated from, the center conductor section and wherein the outer conductor section comprises a plurality of vertically stacked, electrically connected conductive layers each one of the conductive layer having an aperture therein, the aperture being coaxial with, and electrically isolated from, the center conductor section and wherein the outer conductor section is electrically connected to the ground plane conductor.

7. The coaxial transmission line structure recited in claim 6 including an intermediate electrical conductor shielding structure disposed between the center conductor section and the outer conductor section, such intermediate electrical conductor shield section comprising a plurality of electrically conducive vias disposed circumferentially abbot the center conductor section, electrically connecting the ground plane conductor to one of the plurality of vertically stacked, electrically connected conductive layers.

8. A coaxial transmission line structure, comprising:

a center conductor section;

a stack of vertically positioned dielectric layers;

a plurality of electrically conductive layers, each one of the plurality of electrically conductive layers being disposed on a portion of a corresponding one of the stack of vertically positioned dielectric layers;

an outer conductor section disposed about, coaxial with, and electrically isolated from, the center conductor section by the stack of vertically positioned dielectric layers;

wherein the center conductor section comprises:

an inner portion of the plurality of electrically conductive layers;

a first plurality of staggered microvias passing through dielectric layers for electrically interconnecting the inner portion of the plurality of electrically conductive layers between a central input contact and a central output terminal;

wherein the outer conductor section comprises:

an outer portion of the plurality of electrically conductive layers; and a second plurality of staggered microvias passing through dielectric layers for electrically interconnecting the outer portion of the plurality of electrically conductive layers; and wherein the inner portion of one of the plurality of electrically conductive layers has a geometric shape different from a geometrical shape of the inner portion of another one of the plurality of electrically conductive layers.

9. The coaxial transmission line structure recited in claim 8 wherein the geometrical shape of said one of the first plurality of electrically conducive layers is oval and the geometrical shape of said another one of the first plurality of electrically conductive layers is circular.

10. The coaxial transmission line structure recited in claim 9 wherein microvias in the first plurality of microvias passing through one of the stack of vertically positioned dielectric layers are offset from the microvias passing through a lower one of the stack of vertically positioned dielectric layers.

11. The coaxial transmission line structure recited in claim 10 wherein microvias in the second plurality of microvias passing through one of the stack of vertically positioned dielectric layers are offset from the microvias passing through a lower one of the stack of vertically positioned dielectric layers.

12. The coaxial transmission line structure recited in claim 10 wherein the geometrical shape of said one of the first plurality of electrically conducive layers is oval and the geometrical shape of said another one of the first plurality of electrically conductive layers is circular.

13. The coaxial transmission line structure recited in claim 12 wherein the second plurality of microvias is disposed circumferentially around the center conductor section.

14. The coaxial transmission line structure recited in claim 8 wherein the second plurality of electrically conductive vias is disposed circumferentially around the center conductor section.

15. The coaxial transmission line structure recited in claim 8 wherein microvias in the second plurality of microvias passing through one of the stack of vertically positioned dielectric layers are offset from the microvias passing through a lower one of the stack of vertically positioned dielectric layers.

16. The coaxial transmission line structure recited in claim 15 wherein the geometrical shape of said one of the first plurality of electrically conducive layers is oval and the geometrical shape of said another one of the first plurality of electrically conductive layers is circular.

17. The coaxial transmission line structure recited in claim 16 wherein the second plurality of microvias is disposed circumferentially around the center conductor section.

18. The coaxial transmission line structure recited in claim 15 wherein the geometrical shape of said one of the first plurality of electrically conducive layers is oval and the geometrical shape of said another one of the first plurality of electrically conductive layers is circular.

19. The coaxial transmission line structure recited in claim 18 wherein the second plurality of microvias is disposed circumferentially around the center conductor section.

20. The coaxial transmission line structure recited in claim 8 including a ground plane conductor having an aperture therein, the aperture being coaxial with, and electrically isolated from, the center conductor section and wherein the outer conductor section comprises a plurality of vertically stacked, electrically connected conductive layers each one of the conductive layer having an aperture therein, the aperture being coaxial with, and electrically isolated from, the center conductor section and wherein the outer conductor section is electrically connected to the ground plane conductor.

21. The coaxial transmission line structure recited in claim 20 including an intermediate electrical conductor shielding structure disposed between the center conductor section and the outer conductor section, such intermediate electrical conductor shield section comprising a plurality of electrically conducive vias disposed circumferentially abbot the center conductor section, electrically connecting the ground plane conductor to one of the plurality of vertically stacked, electrically connected conductive layers.

* * * * *